US011814859B2

(12) United States Patent
Razzano et al.

(10) Patent No.: US 11,814,859 B2
(45) Date of Patent: Nov. 14, 2023

(54) CANOPY LEG WEIGHTING AND MERCHANDISING APPARATUS

(71) Applicant: Reliable Camping Gear LLC, Phoenix, AZ (US)

(72) Inventors: Douglas Paul Razzano, Phoenix, AZ (US); Jeffrey Alan Davis, Phoenix, AZ (US)

(73) Assignee: Reliable Camping Gear LLC, Phoenix, AZ (US)

( * ) Notice: Subject to any disclaimer, the term of this patent is extended or adjusted under 35 U.S.C. 154(b) by 344 days.

(21) Appl. No.: 16/999,625

(22) Filed: Aug. 21, 2020

(65) Prior Publication Data

US 2021/0054644 A1 Feb. 25, 2021

Related U.S. Application Data

(60) Provisional application No. 62/889,952, filed on Aug. 21, 2019.

(51) Int. Cl.
*E04H 12/22* (2006.01)
*G09F 23/00* (2006.01)
*E04H 15/32* (2006.01)

(52) U.S. Cl.
CPC ..... *E04H 12/2246* (2013.01); *E04H 15/32* (2013.01); *G09F 23/00* (2013.01)

(58) Field of Classification Search
CPC ..... E04H 12/2246
See application file for complete search history.

(56) References Cited

U.S. PATENT DOCUMENTS 5,326,175 A * 7/1994 Carter ..... A01D 75/008 383/22
6,152,300 A * 11/2000 Perkins ..... E06C 7/14 206/349
6,186,662 B1 * 2/2001 Jackson ..... A45C 3/00 383/117
7,946,305 B1 * 5/2011 Mailman ..... A45B 25/22 135/905
8,714,174 B1 * 5/2014 DeSousa ..... E04H 15/58 135/117
8,783,274 B1 * 7/2014 Supino ..... A45F 3/44 248/529
9,125,467 B2 * 9/2015 Randel ..... E04H 15/32
10,753,115 B2 * 8/2020 Perreault ..... A45B 23/00
2015/0040957 A1 * 2/2015 Mallookis ..... E04H 15/62 135/96
2015/0308142 A1 * 10/2015 Pompey ..... E04H 15/32 428/35.5
2016/0024813 A1 * 1/2016 Koyl ..... E04H 12/2269 135/120.1

* cited by examiner

*Primary Examiner* — Noah Chandler Hawk
(74) *Attorney, Agent, or Firm* — Zeman-Mullen & Ford, LLP

(57) ABSTRACT

A sleeve apparatus for weighting a structure, such as a canopy structure, that can also be used to display items on the structure via the items' attachment to the sleeve apparatus. The sleeve apparatus includes at least an elongated body having first and second ends, a first connector element connected to the first end of the elongated body that is capable of encircling and attaching to a rod member and/or a bar member and a second connector element connected to and extending from the second end of the elongated body that is capable of encircling and attaching to the same or a different rod member and/or bar member.

15 Claims, 8 Drawing Sheets

CANOPY LEG WEIGHTING AND MERCHANDISING APPARATUS

CROSS-REFERENCE TO RELATED APPLICATIONS

This application claims priority to provisional patent application having Ser. No. 62/889,952, filed Aug. 21, 2019, which is herein incorporated by reference in its entirety.

FIELD OF INVENTION

The present invention is generally directed to a sleeve type apparatus for use with a canopy structure or other existing structure that enables the canopy structure or other structure to be weighted down and also allows for merchandise, signs, etc. to be displayed on the canopy structure or other structure. The sleeve type apparatus for weighting a structure and/or enabling display of items on the structure includes an elongated body having a first end and a second end, a first connector element connected to and extending from the first end of the elongated body such that the first connector is able to encircle and attach to a rod member or bar member of the structure, and a second connector element connected to and extending from the second end of the elongated body such that the second connector element is able to encircle and attach to the same or a different rod or bar member of the structure.

BACKGROUND OF THE INVENTION

Canopies are commonly used in many activities such as festivals, farmers markets, art & crafts fairs, camping, outdoor recreation, tradeshows, youth sports, professional sporting events, concerts, tailgating, and the like. However, canopies are susceptible to shifting and lifting in windy conditions which can cause property damage and personal injury.

One commonly used approach to improve the stability of canopies includes weighting the base of canopy leg bases with sandbags (FIG. 1 Prior Art). Other commonly used approaches for weighting, securing and stabilizing canopies include plastic leg weights or metal stakes (FIG. 2 Prior Art). However, staking is ineffective in many instances due to the hardness of the ground surrounding the canopy and is oftentimes prohibited by event organizers.

To mitigate the risk of canopy shifting and lifting, many event organizers require vendors and others using a canopy to weight each canopy leg with twenty-five (25) to forty-five (45) pounds of additional weight. Canopy manufacturers make similar weighting recommendations. Leg base weighting can be used as a compliant canopy weighting approach. However, these approaches can cause tripping because the weights, positioned near the ground, are out of the normal line of sight of attendees that may walk close to the canopy legs.

Accordingly, there is a need for a canopy leg weighting system that effectively stabilizes the canopy without creating a tripping hazard for those walking near the canopy. The canopy leg weighting and merchandising apparatus of the present invention does just that and more. The canopy leg weighting and merchandising apparatus of the present invention also provides a means for attaching merchandise, signs, banners, etc. to the apparatus while securing and stabilizing the canopy. In addition, the canopy leg weighting and merchandising apparatus of the present invention enables users to adjust the size and amount of weights used to stabilize the canopy. Finally, the canopy leg weighting and merchandising apparatus of the present invention can be used for other structures besides canopies. In fact, it can be used for and on any type of structure that requires stabilization and/or weighting and/or any type o structure on which a user desires to display merchandise, designs, banners, etc.

SUMMARY OF THE INVENTION

The present invention is directed to an apparatus for weighting a structure and/or enabling the display of items on the structure which includes an elongated body having a first end and a second end, a first connector element connected to and extending from the first end of the elongated body such that the first connector is able to encircle and attach to a rod member or bar member of the structure, and a second connector element connected to and extending from the second end of the elongated body such that the second connector element is able to encircle and attach to the same or a different rod or bar member of the structure. The elongated body may comprise one or more pockets for retaining a weighted element(s). The first and second connector elements may each comprise at least one strap member, at least one rope member, and/or a snap fit connector having oppositely disposed male and female connector members that are attached to a same end of the elongated body so that an end of the elongated body can be connected to the rod member or bar member of the structure. Further, oppositely disposed male and female connectors attached to both first and second ends of the elongated body may be positioned such that the female connector attached to the first end of the elongated body is in vertical or horizontal alignment with the male connector element attached to the second end of the elongated body to allow for a plurality of apparatus to be connected to one another.

In one exemplary embodiment the sleeve apparatus for weighting a structure and/or enabling display of items on the structure includes an elongated sleeve having a first end, a second end, and at least one pocket located between the first and second ends, a first connector element coupled to and extending from the first end of the elongated sleeve where the first connector element is configured to attach the first end of the elongated sleeve to the structure, a second connector element coupled to and extending from the second end of the elongated sleeve where the second connector element is configured to attach the second end of the elongated sleeve to the structure, at least one weighted element contained within the pocket(s), and one or more loop members attached to an exterior of the elongated sleeve for enabling items to be attached to the elongated sleeve. The sleeve apparatus may include a strap member and/or a rope member vertically or horizontally secured to an exterior of the elongated sleeve between the first and second ends of the elongated sleeve for enabling the items to be attached to the elongated sleeve. The strap member and/or rope member may be intermittently secured to the exterior of the elongated sleeve so that a plurality of loops are formed extending from the elongated sleeve for enabling items to be attached to the separate loops extending from the elongated sleeve.

In another exemplary embodiment of the invention, the weighting and merchandising apparatus is specifically directed to weighting and displaying merchandise and/or other items on a canopy or tent like structure. In this embodiment, the apparatus for use with a canopy to weight and/or display items includes an elongated body having a first end and a second end, a first connector element coupled to and extending from the first end of the elongated body where the first connector element is configured to encircle a roof frame element of the canopy to enable the attachment of the first end of the elongated body to the canopy, and a second connector element coupled to and extending from the second end of the elongated body where the second connector element is configured to encircle a leg frame element of the canopy to enable attachment of the second end of the elongated body to the canopy. The first and second connector elements may be in the form of a strap member and/or a rope member where the strap member and/or rope member are adjustable in length. Further, the first and second connectors may each be a snap fit connector having oppositely disposed male and female connector elements that are attached to the same end of the elongated body and a length between the male and female connector elements and the end of the elongated body to which they are attached may be adjustable. In addition, male and female connector element attached to the first and second ends of the elongated body may be positioned such that the female connector element attached to the first end of the elongated body is in vertical or horizontal alignment with the male connector element attached to the second end of the elongated body to allow for a plurality of the weighting and/or displaying apparatus to be connected to one another. The elongated body may comprise a rectangular shape and/or one or more pockets for retaining one or more weights or weighted elements. The apparatus may also include the weights or weighted elements for the pockets. The elongated body may further include one or more loop members attached to it to enable items to be attached to the elongated body. The elongated body may also include a strap member and/or rope member vertically or horizontally secured to the elongated body between the first and second ends of the elongated body for enabling items to be attached to the elongated body. Still further, the strap member and/or rope member may be intermittently secured to the elongated body so that a plurality of loops are formed extending from the elongated body for enabling items to be attached to the separate loops extending from the elongated body.

DESCRIPTION OF EXEMPLARY EMBODIMENTS

Figure 1:
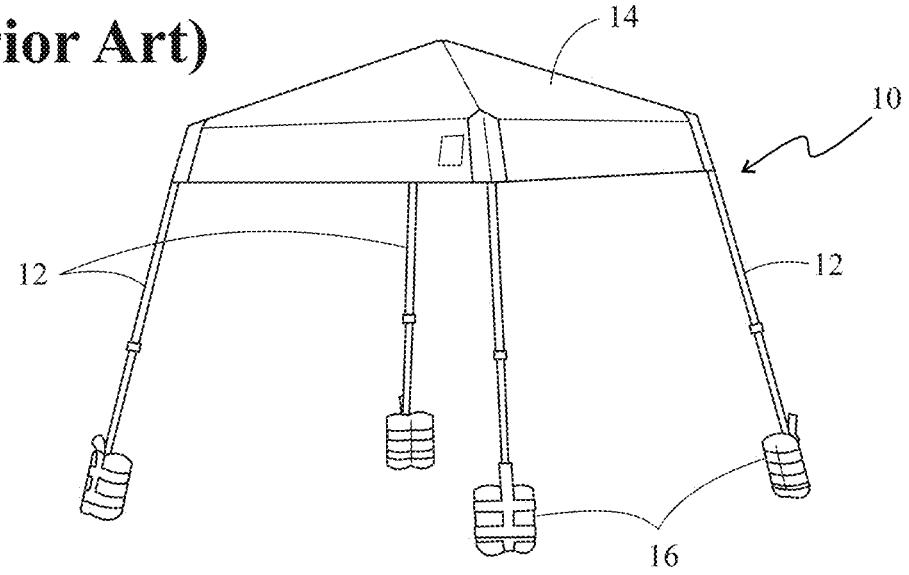
FIG. 1 (Prior Art)
FIG. 1 is a perspective view of a canopy where the legs of the canopy are weighted at the bottom with sand bags or similar types of weights thereby exemplifying the prior art.
Figure 2:
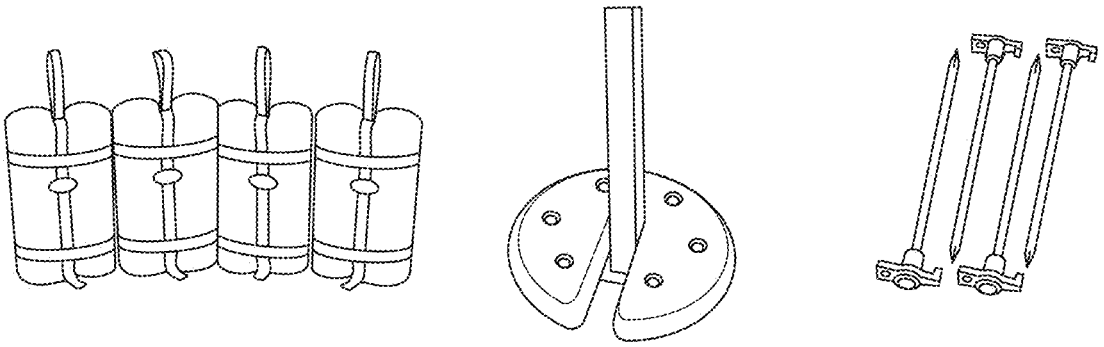
FIG. 2 (Prior Art)
FIG. 2 is a perspective view of different types of weighting elements used in the prior art to weight and secure a canopy or similar type of structure.

The sleeve apparatus of the present invention is designed to weight a structure (such as a canopy, for example) and/or enable display of items on the structure by securing the items to the sleeve apparatus which is then attached to a structure. A conventional canopy structure 10 is shown in prior art FIG. 1 having weighted bags attached to its base. The canopy structure 10 includes leg frames 12, a roof frame (hidden by cover), a cover 14, and weighted bags 16 attached to the bottom of each of the leg frames 12. In conventional canopy configurations, the leg frames 12 are commonly releasably connectable to the roof frame and adjustable in length. Prior art FIG. 2 shows various commercially available objects currently used to weigh down structures (such as canopies) and include sand bags, plastic leg weights, and metal stakes.

Figure 3:
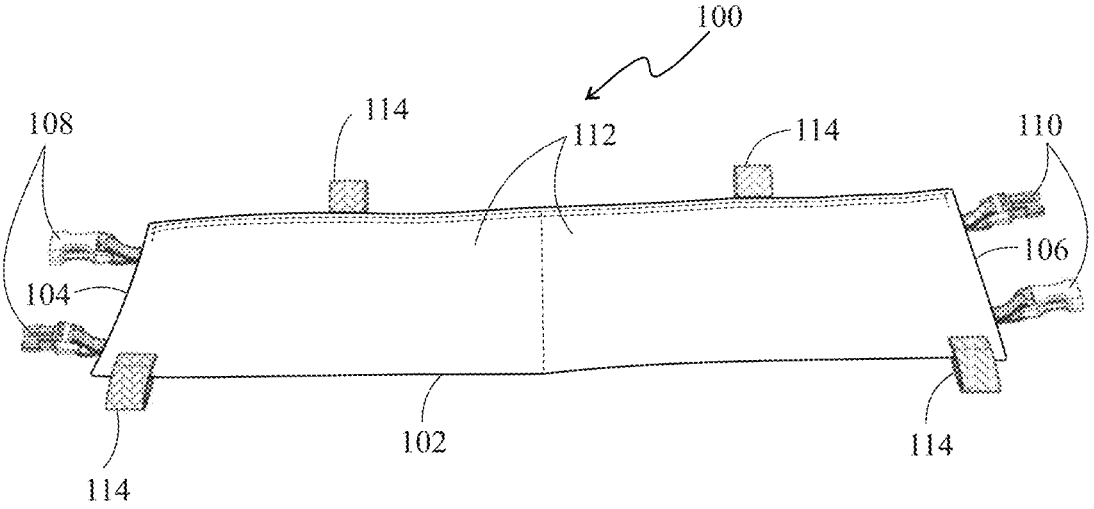
FIG. 3 is a top perspective view of an exemplary embodiment of the sleeve apparatus for weighting a structure (including a canopy) and/or displaying items of the present invention.
Figure 11:
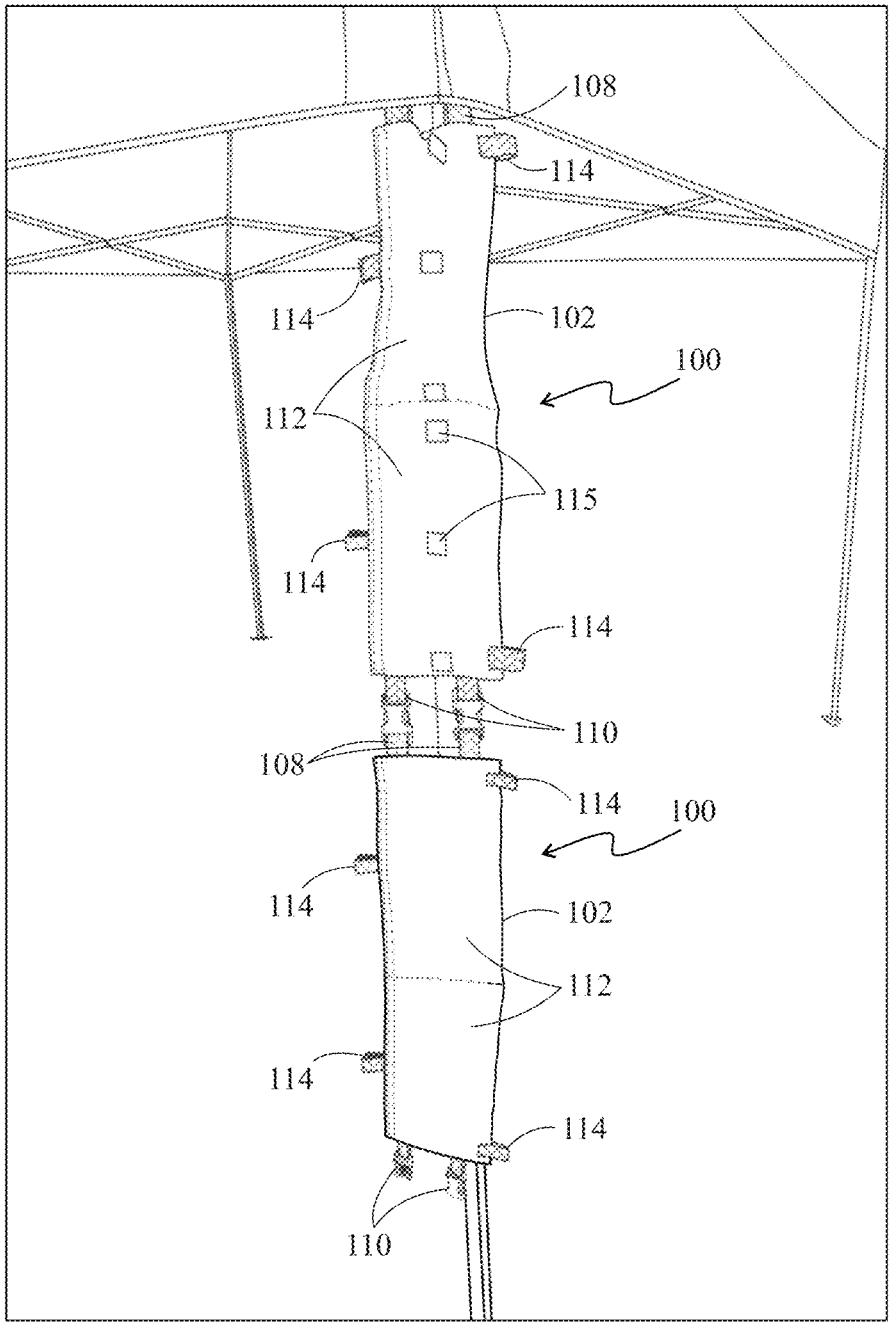
FIG. 11 is a perspective view of two of the exemplary embodiments of the sleeve apparatus for weighting a structure (including a canopy) and/or displaying items of the present invention depicted in FIG. 6 shown connected to one another with the first end of one of the apparatus shown connected to a roof frame element of a canopy or similar structure.
Figure 12:
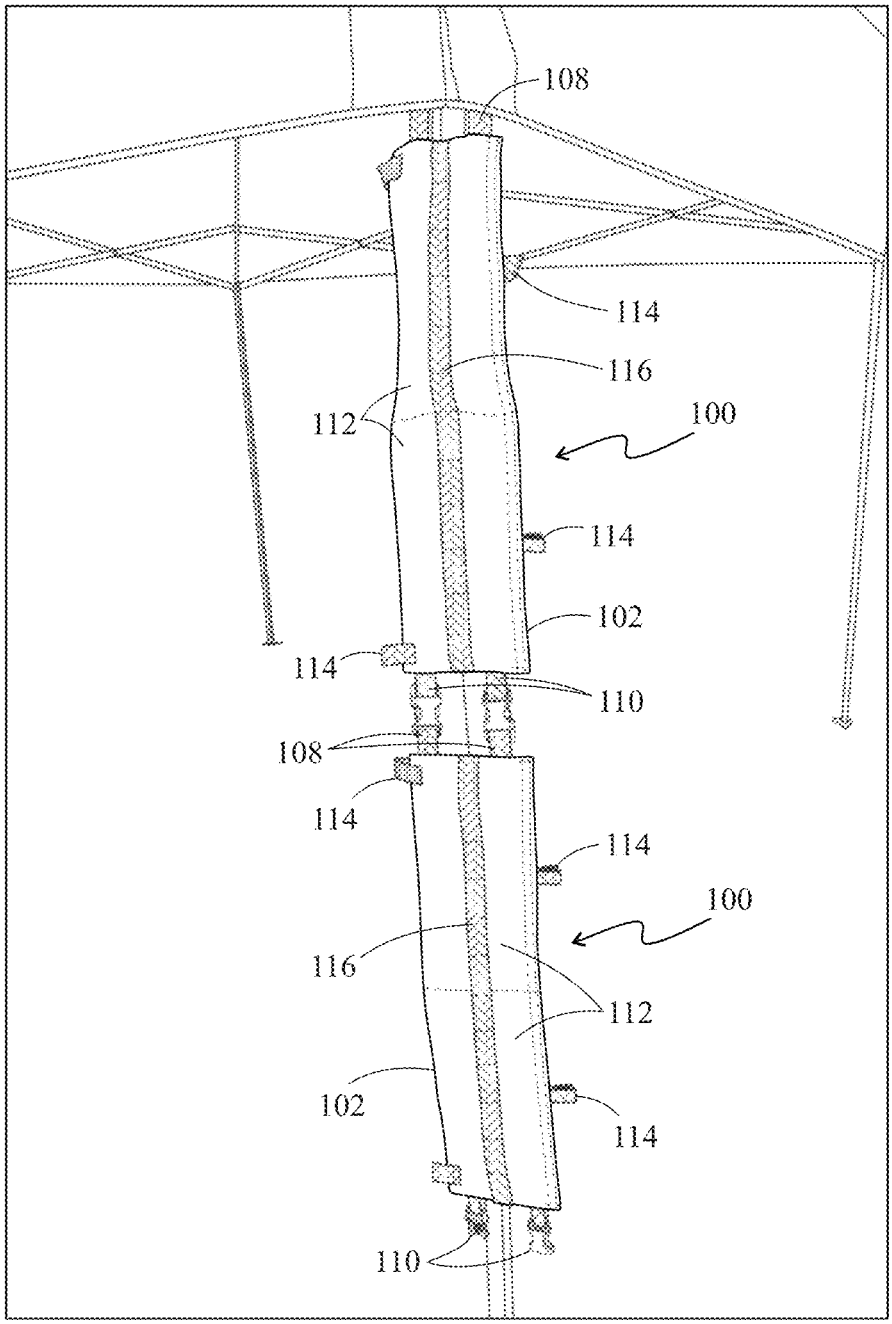
FIG. 12 is a perspective view of two of the exemplary embodiments of the sleeve apparatus for weighting a structure (including a canopy) and/or displaying items of the present invention depicted in FIG. 9 shown connected to one another with the first end of one of the apparatus shown connected to a roof frame element of a canopy or similar structure.

FIG. 3 is a top perspective view of an exemplary embodiment of the sleeve apparatus 100 for weighting a structure (including a canopy) and/or displaying items of the present invention. Sleeve apparatus 100 includes an elongated body 102 having a first end 104 and a second end 106, a first connector element 108 coupled to and extending from the first end 104 of the elongated body 102 such that it is capable of encircling and attaching to a rod member and/or bar member of a structure (such as a canopy structure in which case it would encircle and attach to a roof frame element of the canopy structure), and a second connector element 110 that is cable of encircling and attaching to the same rod member and/or bar member of the structure to which the first connector element 108 is attached or a second rod member and/or bar member of the structure (such as a leg frame element in the case of a canopy structure). As shown in FIG. 3, one exemplary embodiment of the first and second connector elements 108, 110 may comprise a snap fit connector having oppositely disposed male and female connector elements that are attached to a same end of the elongated body 102. Further, the oppositely disposed male and female connector elements may be positioned such that the female connector element attached to the first end 106 of the elongated body 102 is in vertical or horizontal alignment with the male connector element attached to the second end 108 of the elongated body 102 so that two or more sleeve apparatus 100 can be connected to one another as shown in FIGS. 11 and 12.

The elongated body 102 may comprise one or more resealable pockets 112 that are capable of retaining one or more weighted elements such as a weighted bag. The resealable pockets may employ any sealing/resealing mechanism known in the art including, but not limited to, Velcro-like hook and loop material, tabs, zippers, plastic rails/bars such as those used in sandwich bags, etc. as long as it enables the weighted bag to be secured within, and removed from, the pocket. Pull tabs may be provided to facilitate opening of the pockets. Any configuration of pocket size, and number(s) of pockets may be used to accommodate weighted raw materials (such as steel shot, metal, lead washers, rocks, pennies and the like) into the resealable seamed pockets of the body. In this way, the user can adjust the weight needed to secure and stabilize the canopy.

Figure 13:
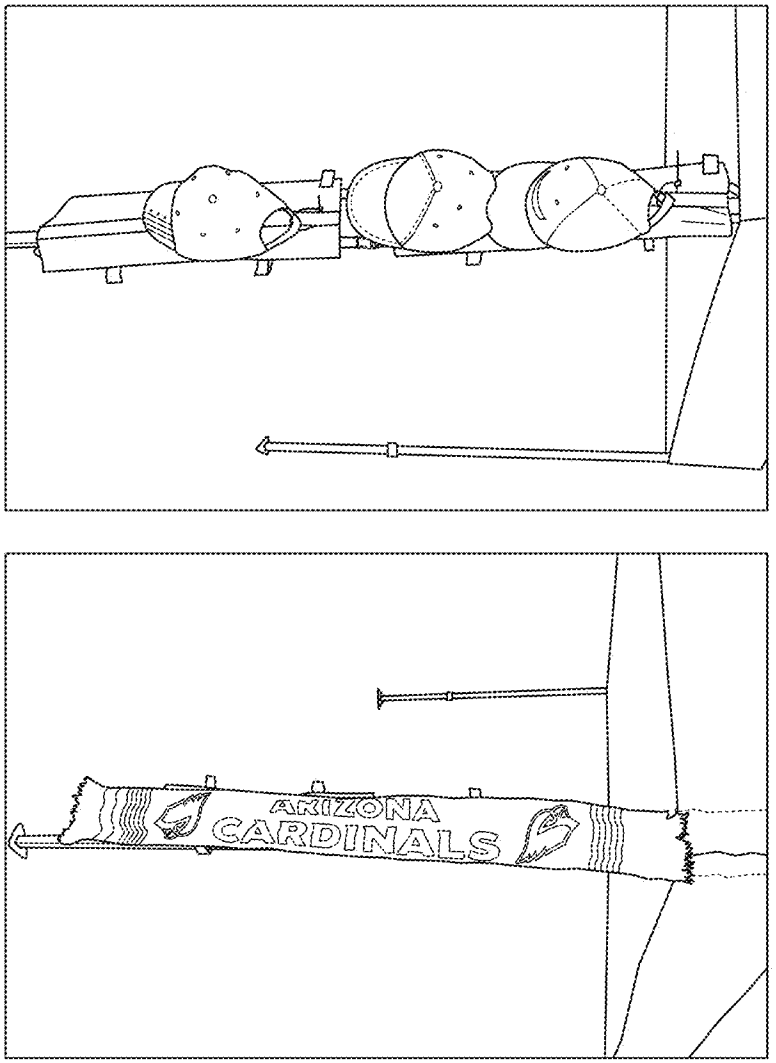
FIG. 13 is a perspective view of the exemplary embodiments of the sleeve apparatus of the present invention illustrated in FIGS. 11 and 12 shown with hats and a banner attached to the sleeve apparatus.

In addition, the elongated body 102 may further include one or more loop members 114 attached to it for enabling items to be attached to the elongated body 102. These attachment loops 114 enable vendors or users to attach items such as merchandise, advertising banners, signs, etc. to the sleeve apparatus 100 which is in turn attached to a structure (such as a canopy structure, for example) as shown in FIG. 13.

Figure 4:
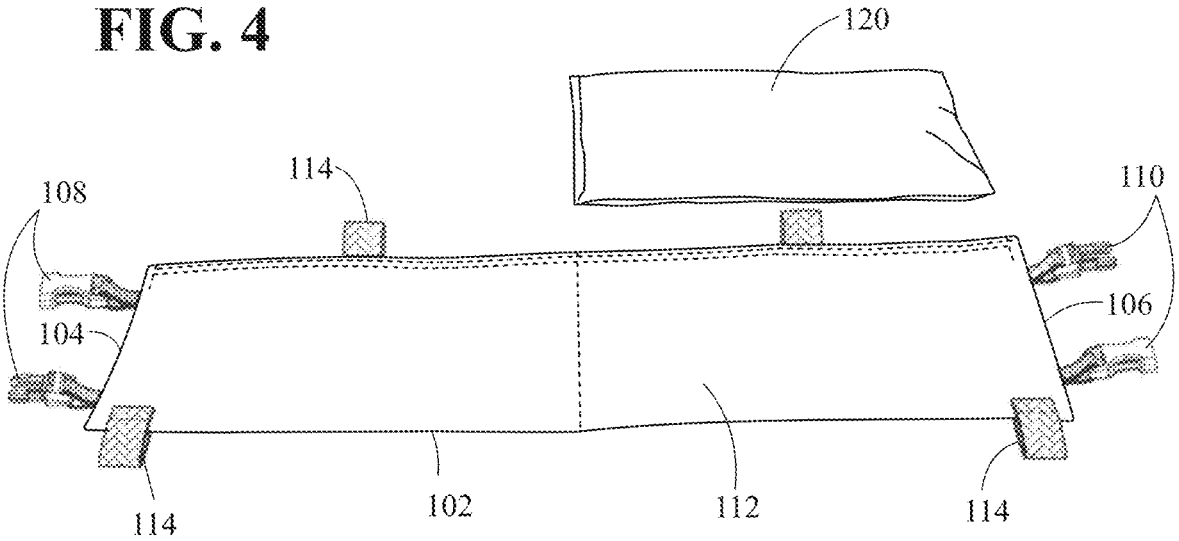
FIG. 4 is the same top perspective view of the present invention depicted in FIG. 3 shown with the weight/weighted element removed from a pocket of the elongated body of the apparatus of the present invention.

FIG. 4 is the same top perspective view of the present invention depicted in FIG. 3 shown with the weight/weighted element (such as a weighted bag, for example) 120 removed from a pocket 112 of the elongated body 102 of the apparatus 100 of the present invention. The weight/weighted element(s) 120 may include sand, steel shot, metal, or any other heavy material that is sealed within a bag, such as an 8 mil. poly bag, for example, that can in turn be placed within a pocket 112 of the elongated body 102 of the sleeve apparatus 100. While any denomination of weights can be used with the invention, ten pound (10 lb.) weights have been found to be suitable. However, a user can adjust the amount of weight placed within the pockets 112 of the elongated body 102 of the sleeve apparatus 100 to restrict, secure, and/or stabilize the structure (such as a canopy) as needed.

Figure 5:
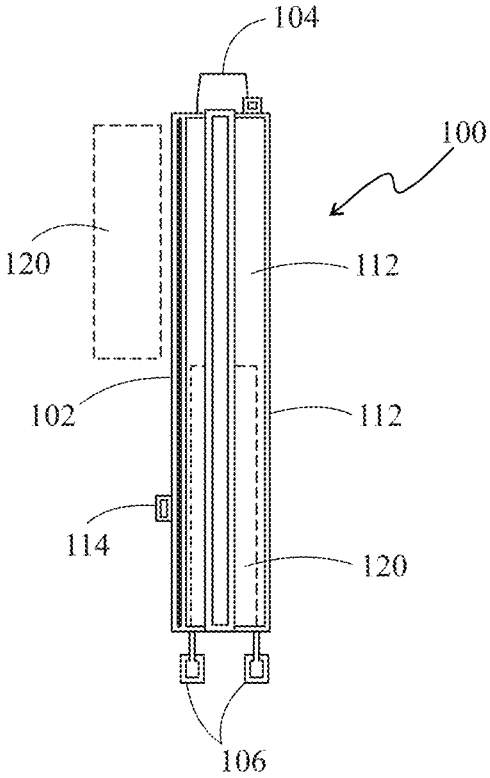
FIG. 5 is a detailed schematic of the apparatus in a vertical position as it would be attached to the leg of a structure (including the leg of a canopy)

A detailed schematic of the apparatus in a vertical position as it would be attached to the leg of a structure (including the leg of a canopy) is shown in FIG. 5. The elongated body 102 of the sleeve apparatus 100 is shown in a vertical position as it would be when connected to the leg of a structure such as a canopy. First connector element 108 would encircle a roof element or leg element of the structure and weight/weighted element(s) 120 would be placed within pockets 112 of the elongated body 102 of the sleeve apparatus 100. The second connector element 110 can encircle and be secured to a leg element of the structure or, alternatively, it can be connected to a first connector element 108 of a separate sleeve apparatus 100 so that two sleeve apparatus are connected to one another (See FIGS. 11 and 12).

Figure 6:
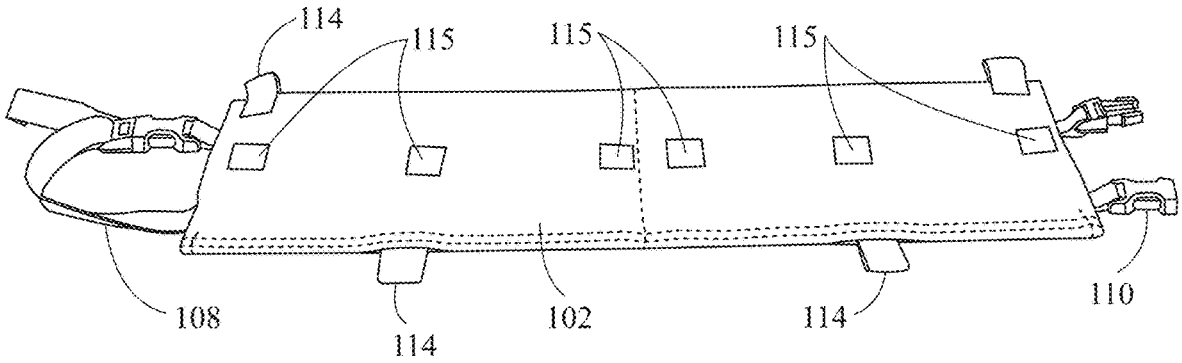
FIG. 6 is a top perspective view of another exemplary embodiment of the sleeve apparatus for weighting a structure (including a canopy) and/or displaying items of the present invention.
Figure 7:
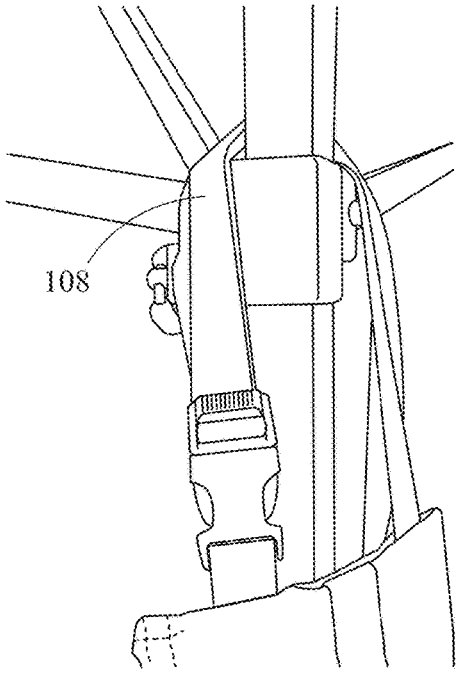
FIG. 7 is a perspective view of an exemplary embodiment of a connector element of the present invention shown connected to a roof frame element of a canopy or similar structure.
Figure 8:
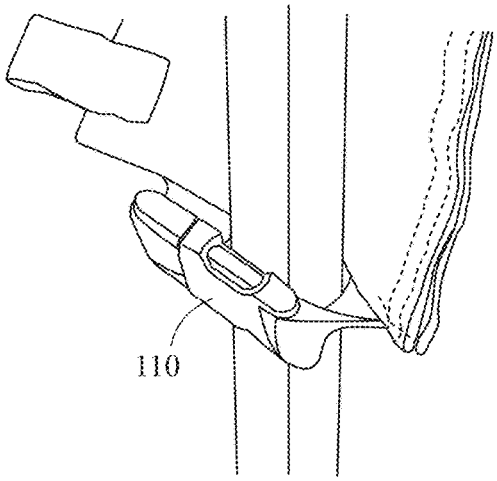
FIG. 8 is a perspective view of another exemplary embodiment of a connector element of the present invention shown connected to a leg frame element of a canopy or similar structure.

FIG. 6 is a top perspective view of another exemplary embodiment of the sleeve apparatus 100 for weighting a structure (including a canopy) and/or displaying items of the present invention. In this exemplary embodiment, sleeve apparatus 100 includes a plurality of Velcro hook and loop members 115, or loop members similar to loop members 114, that are also positioned on a middle exterior surface of the elongated body member 102. As previously mentioned, loop members 114 enable vendors or users to attach items such as merchandise, advertising banners, signs, etc. to the sleeve apparatus 100 which is in turn attached to a structure (such as a canopy structure, for example) as shown in FIG. 13. Velcro hook and loop members 115 serve this same function. The exemplary embodiment shown in FIG. 6 also includes adjustable strap members as the first and second connector elements 108, 110. The frame strap is preferably adjustable in length to permit raising and lowering the elongated body 102 to adjust the distance the body 102 hangs from the roof frame and therefore to adjust the banner or merchandising height. Those skilled in the art will appreciate that the illustrated connectors are envisioned to accommodate a variety of conventional attachment methods to connect the elongated body 102 of sleeve apparatus 100 to a structure (such as to a canopy roof frame element and/or leg frame element of a canopy structure). For example, webbing, snap clips, clamps, carabiners, rope, bungee cords, strapping cord, and the like can be used to couple the first and/or second connectors 108, 110 to a structure. FIG. 7 shows an adjustable strap member as the first connector element 108 with the adjustable strap member shown connected to a roof frame element of a canopy structure. FIG. 8 shows a snap fit connector having male and female connector elements as the second connector element 110 with the snap fit connector shown connected to a leg frame element of a canopy structure.

Figure 9:
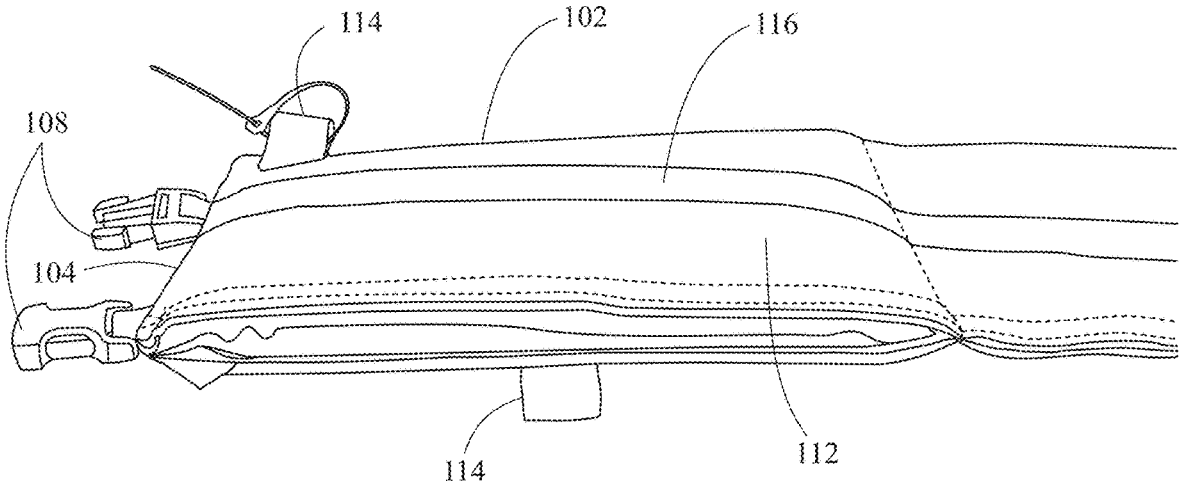
FIG. 9 is a top perspective view of yet another exemplary embodiment of the sleeve apparatus for weighting a structure (including a canopy) and/or displaying items of the present invention.

FIG. 9 is a top perspective view of yet another exemplary embodiment of the sleeve apparatus 100 for weighting a structure (including a canopy) and/or displaying items of the present invention. In this exemplary embodiment, sleeve apparatus 100 includes a strap member 116 that is positioned on a middle exterior surface of the elongated body 102 of the sleeve apparatus 100 between the first and second ends 104, 106 of the elongated body member 102. Strap member 116 may be intermittently secured to the exterior of the elongated body 102 so that a plurality of loops are formed by the strap which extend from the elongated body 102 for enabling items to be attached to the separate loops. These attachment loops, like attachment loops 114 previously described above, enable vendors or users to attach items such as merchandise, advertising banners, signs, etc. to the sleeve apparatus 100 which is in turn attached to a structure (such as a canopy structure, for example) as showy in FIG. 13. In addition, strap member 116 may be made of a Velcro hook and loop type fastening material to enable merchandise, banners, signs, etc. to be attached to sleeve apparatus 100.

Figure 10:
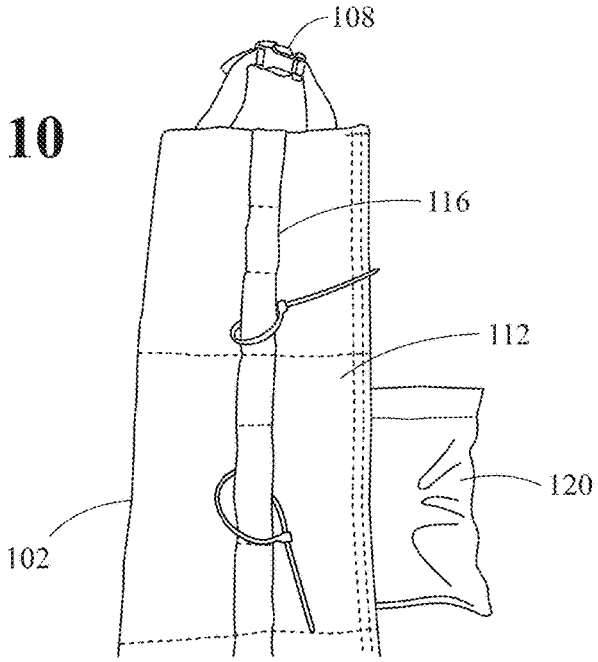
FIG. 10 is a top perspective view of still another exemplary embodiment of the sleeve apparatus for weighting a structure (including a canopy) and/or displaying items of the present invention that includes a connector element having a caribiner attached to a non-adjustable strap where the caribiner can be used to connect the apparatus to the structure.

FIG. 10 is a top perspective view of still another exemplary embodiment of the sleeve apparatus 100 for weighting a structure (including a canopy) and/or displaying items of the present invention that includes a connector element 108 having a caribiner attached to a non-adjustable strap where the caribiner can be used to connect the apparatus 100 to the structure. Other commercially available connectors such as webbing, snap clips, clamps, rope, bungee cords, strapping cord, etc. may also be used alone or in combination for connector elements 108, 110. In addition, this exemplary embodiment includes the strap member 116 described above with reference to FIG. 9 and shows zip ties connected to the separate loops created by the strap member 116 which enable items to be connected to the elongated body 102 of the sleeve apparatus 100. A weighted bag 120 is also shown outside of a resealable pocket 112 of the elongated body 102.

FIG. 11 is a perspective view of two of the exemplary embodiments of the sleeve apparatus 100 for weighting a structure (including a canopy) and/or displaying items of the present invention depicted in FIG. 6 shown connected to one another with the first end of one of the apparatus 100 shown connected to a roof frame element of a canopy or similar structure. FIG. 12 is a perspective view of two of the exemplary embodiments of the sleeve apparatus 100 for weighting a structure (including a canopy) and/or displaying items of the present invention depicted in FIG. 9 shown connected to one another with the first end of one of the apparatus 100 shown connected to a roof frame element of a canopy or similar structure.

The drawings and description of exemplary embodiments of the invention herein shows various exemplary embodiments of the invention. These exemplary embodiments and modes are described in sufficient detail to enable those skilled in the art to practice the invention and are not intended to limit the scope, applicability, or configuration of the invention in any way. Rather, the following disclosure is intended to teach both the implementation of the exemplary embodiments and modes and any equivalent modes or embodiments that are known or obvious to those reasonably skilled in the art. Additionally, all included examples are non-limiting illustrations of the exemplary embodiments and modes, which similarly avail themselves to any equivalent modes or embodiments that are known or obvious to those reasonably skilled in the art.

Other combinations and/or modifications of structures, arrangements, applications, proportions, elements, materials, or components used in the practice of the instant invention, in addition to those not specifically recited, can be varied or otherwise particularly adapted to specific environments, manufacturing specifications, design parameters, or other operating requirements without departing from the scope of the instant invention and are intended to be included in this disclosure.

Unless specifically noted, it is the Applicant's intent that the words and phrases in the specification and the claims be given the commonly accepted generic meaning or an ordinary and accustomed meaning used by those of ordinary skill in the applicable arts. In the instance where these meanings differ, the words and phrases in the specification and the claims should be given the broadest possible, generic meaning. If any other special meaning is intended for any word or phrase, the specification will clearly state and define the special meaning.

The invention claimed is:

1. An apparatus for use with a canopy to weight the canopy and/or display items comprising:

an elongated body having a first end and a second end;

a first snap fit connector element comprising oppositely disposed male and female connector elements each extending from the first end of the elongated body wherein the first snap fit connector element is configured to encircle a roof frame element of the canopy to enable attachment of the first end of the elongated body to the canopy; and a second snap fit connector element comprising oppositely disposed male and female connector elements each extending from the second end of the elongated body wherein the second snap fit connector element is configured to encircle a leg frame element of the canopy to enable attachment of the second end of the elongated body to the canopy, wherein the oppositely disposed male and female connector elements attached to the first and second ends of the elongated body are positioned such that the female connector element attached to the first end of the elongated body is in vertical or horizontal alignment with the male connector element attached to the second end of the elongated body thus allowing for a plurality of weighting and/or displaying apparatus to be connected to one another.

2. The apparatus of claim 1 wherein a length between the male and female connector elements and the end of the elongated body from which they extend is adjustable.

3. The apparatus of claim 1 wherein the elongated body comprises a rectangular shape.

4. The apparatus of claim 1 wherein the elongated body comprises one or more pockets for retaining a weighted element.

5. The apparatus of claim 4 further comprising one or more weighted elements contained within the one or more pockets of the elongated body.

6. The apparatus of claim 1 further comprising one or more loop members attached to the elongated body member for enabling items to be attached to the elongated body.

7. The apparatus of claim 1 further comprising at least one of a strap member or a rope member vertically or horizontally secured to the elongated body between the first and second ends of the elongated body for enabling items to be attached to the elongated body.

8. The apparatus of claim 7 wherein the at least one strap member or rope member is intermittently secured to the elongated body such that a plurality of loops are formed extending from the elongated body for enabling items to be attached to the separate loops extending from the elongated body.

9. A sleeve apparatus for weighting a structure and/or enabling display of items on the structure comprising:

an elongated body having a first end and a second end;

a first snap fit connector element comprising oppositely disposed male and female connector elements each extending from the first end of the elongated body wherein the first snap fit connector element is configured to encircle and attach to at least one of a rod member or a bar member of the structure; and a second snap fit connector element comprising oppositely disposed male and female connector elements each extending from the second end of the elongated body wherein the second snap fit connector element is configured to encircle and attach to the at least one rod member or bar member of the structure or at least one of a second bar member or second rod member of the structure, wherein the oppositely disposed male and female connector elements attached to the first and second ends of the elongated body are positioned such that the female connector element attached to the first end of the elongated body is in vertical or horizontal alignment with the male connector element attached to the second end of the elongated body thus allowing for a plurality of sleeve apparatus to be connected to one another.

10. The sleeve apparatus of claim 9 wherein the elongated body comprises one or more pockets for retaining a weighted element.

11. The sleeve apparatus of claim 10 further comprising one or more weighted elements contained within the one or more pockets of the elongated body.

12. The sleeve apparatus of claim 9 further comprising one or more loop members attached to the elongated body member for enabling items to be attached to the elongated body.

13. A sleeve apparatus for weighting a structure and/or enabling display of items on the structure comprising:

an elongated sleeve having a first end, a second end, and at least one pocket located between the first and second ends;

a first connector element coupled to and extending from the first end of the elongated sleeve wherein the first connector element is configured to attach the first end of the elongated sleeve to the structure;

a second connector element coupled to and extending from the second end of the elongated sleeve wherein the second connector element is configured to attach the second end of the elongated sleeve to the structure, wherein the first and second connector elements each comprise oppositely disposed male and female connector elements wherein the male and female connector elements attached to the first and second ends of the elongated body are positioned such that the female connector element attached to the first end of the elongated body is in vertical or horizontal alignment with the male connector element attached to the second end of the elongated body thus allowing for a plurality of sleeve apparatus to be connected to one another;

a weighted element contained within the at least one pocket; and at least one of a strap member or a rope member secured to an exterior of the elongated sleeve between the first and second ends of the elongated sleeve and along an entire longest length of the elongated sleeve for enabling items to be attached along the entire longest length of the elongated sleeve.

14. The sleeve apparatus of claim 13 wherein the at least one strap member or rope member is intermittently secured to the exterior of the elongated sleeve such that a plurality of loops are formed extending from the elongated sleeve for enabling items to be attached to the separate loops extending from the elongated sleeve.

15. The sleeve apparatus of claim 13 further comprising one or more loop members attached to an exterior of the elongated sleeve around a perimeter of the elongated sleeve for enabling items to be attached to the elongated sleeve.

* * * * *